US009668525B2

(12) United States Patent
Boyle et al.

(10) Patent No.: US 9,668,525 B2
(45) Date of Patent: Jun. 6, 2017

(54) PANTS INCLUDING SELECTIVELY LOCATED STRETCH PANELS

(71) Applicant: Alf Wear, Salt Lake City, UT (US)

(72) Inventors: Kevin Boyle, Park City, UT (US); Holger Kuhr, Sandy, UT (US)

(73) Assignee: Alf Wear, Salt Lake City, UT (US)

( * ) Notice: Subject to any disclaimer, the term of this patent is extended or adjusted under 35 U.S.C. 154(b) by 0 days.

(21) Appl. No.: 14/532,415

(22) Filed: Nov. 4, 2014

(65) Prior Publication Data

US 2016/0120246 A1 May 5, 2016

(51) Int. Cl.
*A41D 1/06* (2006.01)
*A41D 27/20* (2006.01)

(52) U.S. Cl.
CPC ..... *A41D 1/06* (2013.01); *A41D 27/20* (2013.01); *A41D 27/205* (2013.01); *A41D 2400/38* (2013.01)

(58) Field of Classification Search
CPC ..... A41D 1/06; A41D 27/20
USPC ..... 2/227, 247
See application file for complete search history.

(56) References Cited

U.S. PATENT DOCUMENTS 269,479 A 12/1882 Stretch et al.
2,800,663 A * 7/1957 Falk ..... A41D 27/20 2/247
4,371,989 A * 2/1983 Polsky ..... A41D 1/08 2/227
4,470,156 A * 9/1984 Duerbeck ..... A41D 1/08 2/227
5,634,215 A 6/1997 DeBaene
7,051,372 B2 * 5/2006 Mistura ..... A41D 27/24 2/69
D668,433 S 10/2012 Boyle
D679,483 S 4/2013 Fuerst
D696,487 S 12/2013 Kurmanow
D730,625 S 6/2015 Boyle
D734,000 S 7/2015 Boyle
D736,495 S 8/2015 Bednarz
(Continued)

OTHER PUBLICATIONS

Kuhl Radikl Reviews, accessed Oct. 20, 2015, reviews dated Jan. 8, 2014, http://www.kuhl.com/kuhl/mens/pants/radikl-pant/.*
(Continued)

*Primary Examiner* — Anna Kinsaul
*Assistant Examiner* — Heather Mangine
(74) *Attorney, Agent, or Firm* — Venable LLP; Steven J. Schwarz

(57) ABSTRACT

Pants can include a waist portion including a waist band; first and second legs extending from the waist portion, each of the first and second legs including a front panel and a rear panel formed at least partially of a woven fabric, and a side stretch panel extending lengthwise along at least a portion of the wearer's leg between the front panel and the rear panel. Each side stretch panel can include a knitted fabric having fore and aft side edges joined to the front panel and rear panel, respectively. First and second front pockets can be located below the waist band, and each of the first and second front pockets can have a pocket welt formed of a woven fabric, the pocket welt extending from the woven fabric of the front panel to the woven fabric of the rear panel of the respective leg.

19 Claims, 10 Drawing Sheets

(56) References Cited

U.S. PATENT DOCUMENTS

| | | | | |
|---|---|---|---|---|
| 2002/0138893 | A1* | 10/2002 | Culhane | A41D 1/067 2/79 |
| 2005/0246818 | A1 | 11/2005 | Kim | |
| 2013/0125287 | A1* | 5/2013 | Boyle | A41D 15/002 2/70 |
| 2013/0212779 | A1* | 8/2013 | Dowling | A41F 9/02 2/243.1 |
| 2014/0143930 | A1 | 5/2014 | Kuraoka et al. | |

OTHER PUBLICATIONS

Notice of Allowance issued Oct. 13, 2015 in U.S. Appl. No. 29/508,190.

* cited by examiner

PANTS INCLUDING SELECTIVELY LOCATED STRETCH PANELS

TECHNICAL FIELD

This patent application relates generally to clothing, such as pants, shorts, and the like. More specifically, the present application relates to pants including a combination of different materials that are selectively located to optimize durability, fit, and comfort.

BACKGROUND

Clothing for people with an active lifestyle has existed for a number of years. Such clothing is typically used during recreational activities such as hiking, climbing, skiing, and other outdoor activities. Additionally, recreational clothing is often worn for everyday life activities. Examples of recreational clothing include pants and shorts, as well as shirts, jackets, and other types of outerwear. When designing clothing, designers often have to choose between fabrics that are durable, such as wovens, and fabrics that are comfortable (e.g., stretchy), such as knits.

BRIEF DESCRIPTION OF THE DRAWINGS

The foregoing and other features and advantages will be apparent from the following, more particular, description of various exemplary embodiments, as illustrated in the accompanying drawings, wherein like reference numbers generally indicate identical, functionally similar, and/or structurally similar elements.

DETAILED DESCRIPTION

Figure 1:
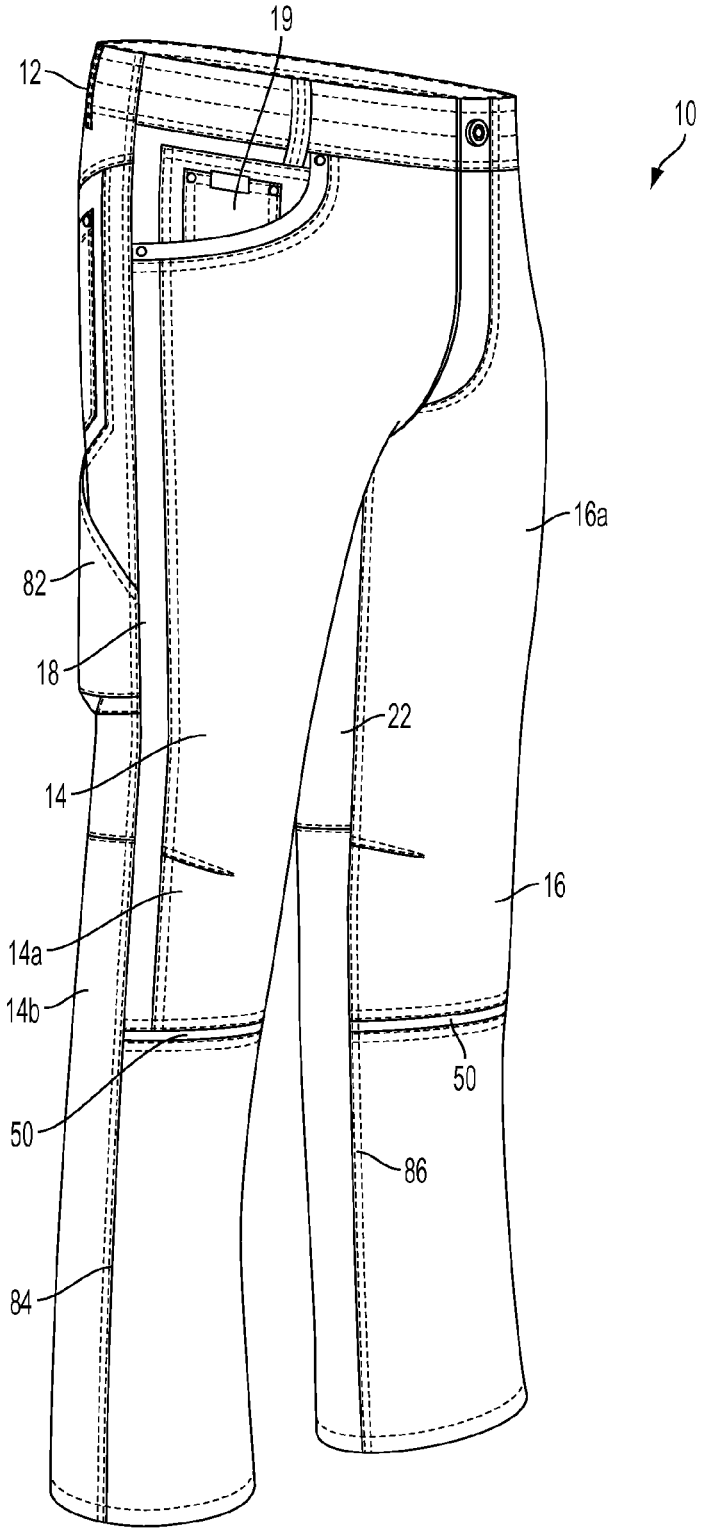
FIG. 1 is a front-right perspective view of an embodiment of pants according to the present invention.

Various embodiments of the invention are discussed in detail below. While specific embodiments are discussed, it should be understood that this is done for illustration purposes only. A person skilled in the relevant art will recognize that other components and configurations can be used without departing from the spirit and scope of the invention.

As used herein, terms such as "front," "back," "left," "right," "upper," and "lower" are used to describe positions relative to one another only and not to denote an absolute position. For example, an "upper portion" can become a "left," "right," or "lower" portion by rotating the item, although it can still be referred to as an "upper" portion of the item.

Embodiments can provide pants and shorts (referred to collectively herein as "pants," unless otherwise specified) that selectively combine durable and stretchy materials to provide comfort, fit, and durability. For example, the pants can include an exoskeleton of relatively stretch-resistant materials, such as woven fabrics, to provide durability and structure, as well as panels of relatively stretchy materials, such as knitted fabrics, for fit and maneuverability.

Generally, fabrics can be classified into two categories based on how they are manufactured—knits and wovens. Knitted fabrics are produced on knitting machines that "knit" different yarns together in rows of plain and rows of purl. Knitted fabrics are known to stretch. Some examples of knitted fabrics include, without limitation, T-shirt fabric, sweatshirt fabric, knitwear, jersey, mesh, toweling, felt, and LA COSTE™. Woven fabrics are produced on looms that "weave" yarns together by interlacing threads both horizontally and vertically. Typically, woven fabrics do not stretch unless LYCRA® (a brand of elastene or spandex), elastic, or spandex fibers are woven into the fabric at the same time. Linen, denim, cotton twill, satin, chiffon, corduroy, tweed, and canvas are examples of typical woven fabrics. Knit fabrics are often known for their fit and comfort, while woven fabrics are often known for their durability. Embodiments of the present invention can provide an exoskeleton of woven fabric including panels of knit fabrics in order to provide both comfort/fit and durability.

Referring to FIGS. 1-5, an embodiment of pants 10 according to the present invention is shown. The pants 10 can generally include a waist portion 12 that fits around the wearer's waist and crotch. The pants can also include first and second legs 14, 16, such as right and left legs. As shown in FIGS. 1-5, the first and second legs 14, 16 can be long-legs that extend over substantially all of a wearer's legs (e.g., to their feet or ankles), or alternatively, short-legs that cover only a portion of the wearer's legs (e.g., extend to the knee). Alternatively, pants 10 can have leg lengths somewhere between long-legs and short-legs, for example, as may be the case with "knickers." As will be described in more detail below, the pants 10 can include an exoskeleton of woven fabric, and a plurality of stretch panels made of knitted fabric. For example, the pants 10 can include first and second side stretch panels 18, 20 that extend along the wearer's outer thigh. According to embodiments, the first and second side stretch panels 18, 20 can also extend above the front pockets 19, as will be described in more detail below. The first and second side stretch panels 18, 20 can comprise, for example, a knitted fabric. According to embodiments, the pants 10 can also include a crotch gusset 22 in the form of a stretch panel, for example, formed from a knitted fabric. According to embodiments, the rear pockets 24 can be mounted on a stretch panel 26, such as, for example, a knitted fabric. Additional details regarding the aforementioned stretch panels will be provided below. As an alternative to using knitted fabrics for the stretch panels and woven fabrics for the exoskeleton, alternative embodiments can use combinations of woven fabrics having different stretch properties, for example, based on the LYCRA®, elastic, or spandex content. According to such embodiments, woven fabrics having a relatively higher LYCRA®, elastic, or spandex content can be used for the stretch panels, and woven fabrics having a relatively lower LYCRA®, elastic, or spandex count can be used for the surrounding exoskeleton.

Figure 5:
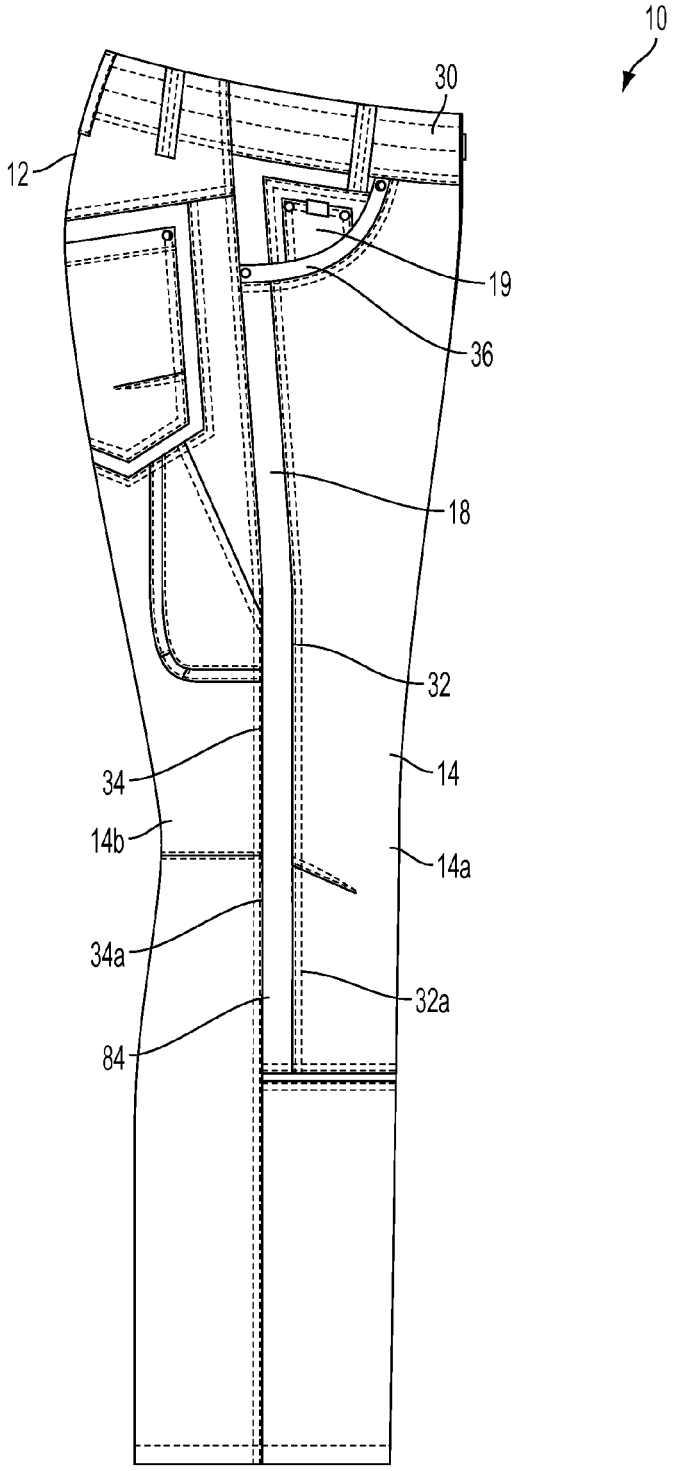
FIG. 5 is a right side view of the pants of FIG. 1.
Figure 6:
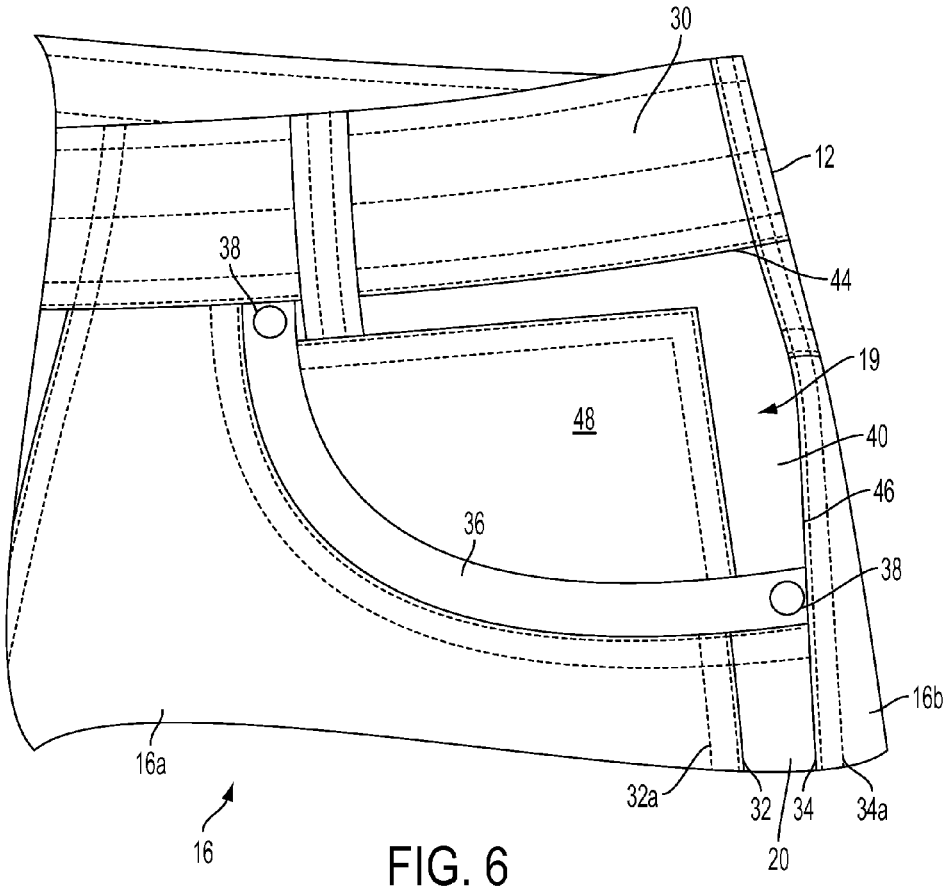
FIG. 6 is an enlarged view of an embodiment of a front pocket of the pants of FIG. 1.
Figure 7:
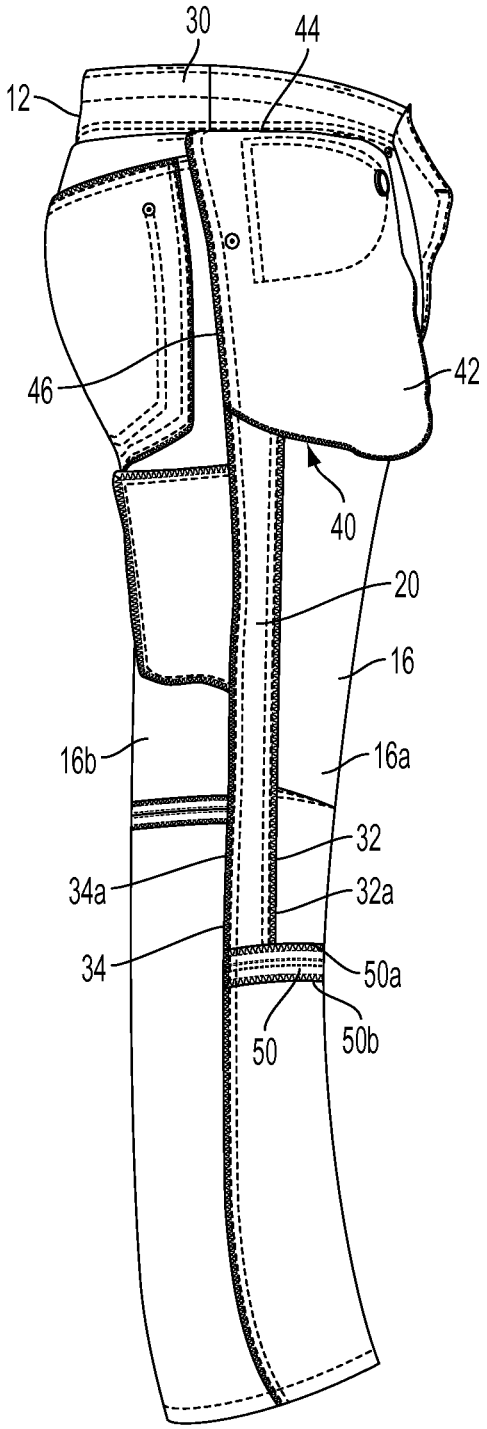
FIG. 7 is a side view of the pants of FIG. 1, shown inside-out.

Referring to FIGS. 5-7, embodiments of the front pockets 19 and side stretch panels 18, 20 are described in more detail. The waist portion of pants 10 can include a waist band 30, formed, for example, of a woven fabric. The legs 14, 16 can each include a front panel 14*a*, 16*a*, and a rear panel 14*b*, 16*b*, each of which can be formed at least partially of a woven fabric. As best shown in FIGS. 5 and 7, side stretch panel 18, 20 can extend along the length of the respective leg 14, 16 between the respective front panel 14*a*, 16*a* and the respective rear panel 14*b*, 16*b*, thereby joining the front and rear panels together in a stretchable manner. The side stretch panels 18, 20 can have fore and aft side edges 32, 34 joined to the woven portion of the front panel 14*a*, 16*a* and rear panel 14*b*, 16*b*, respectively, for example, by stitching 32*a*, 34*a* (shown in FIGS. 5-7), bonding, ultrasonic welding, or other technique known in the art. The side stretch panels 18, 20 can be formed of a knitted fabric in order to provide flexibility between the front and rear panels of the respective leg 14, 16.

Referring to FIG. 6, an embodiment of one of the front pockets 19 is shown in more detail. Each of the first and second (e.g., left and right) front pockets can have a pocket welt 36 extending from the woven fabric of the front panel 16*a* to the woven fabric of the rear panel 16*b* of the respective leg 16. The pocket welt 36 can comprise a woven fabric in order to provide a relatively stiff connection between the front panel 16*a* and rear panel 16*b* in order to reinforce the structure of the pants 10. According to embodiments, the pocket welt 36 can be secured to the front and rear panels 16*a*, 16*b* using rivets 38, and/or by stitching, bonding, ultrasonic welding, or other technique known in the art. According to embodiments, the pocket welt 36 can comprise two or more overlapping layers of woven fabric, for example, folded over on top of one another.

Referring to FIG. 6, according to embodiments, each pocket welt 36 can extend from the waist band 30, or a point immediately adjacent to the waist band 30, to the woven fabric of the rear panel 14*b*, 16*b* of the respective leg 14, 16. However, other embodiments can have the pocket welt 36 joined to the front of the pants 10 itself, or other area in the vicinity of the front pocket 19.

Figure 8:
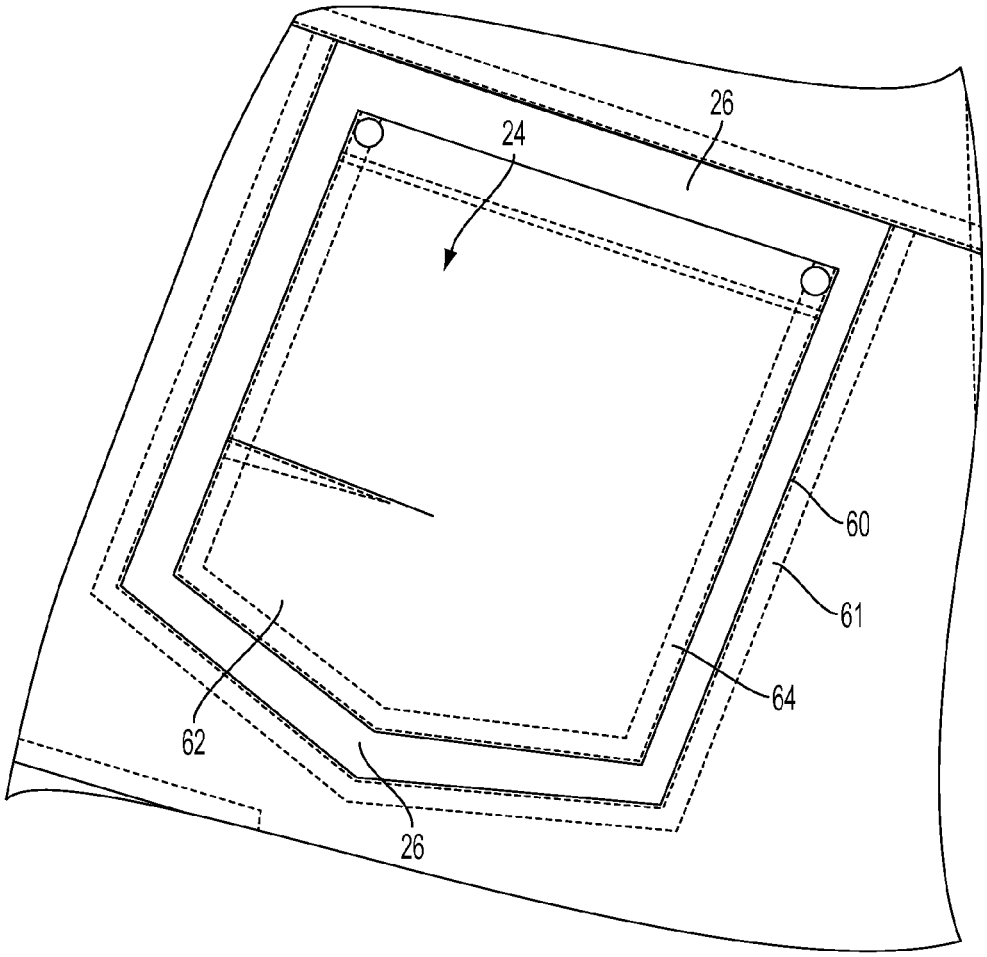
FIG. 8 is an enlarged view of a rear pocket of the pants of FIG. 1.

Referring to FIGS. 6-8, each of the front pockets 19 can include an inner front pocket layer 40 (see FIG. 6) formed of a stretch material, such as knitted fabric. Each of the pockets 19 can also include an outer front pocket layer 42 (see FIG. 7) formed of a stretch material, such as knitted fabric. Both the inner front pocket layer 40 and outer front pocket layer 42 can have a top edge (identified collectively as 44 in FIG. 6) that is joined to the waist band 30, for example, by stitching. Likewise, both the inner front pocket layer 40 and outer front pocket layer 42 can have a side edge (identified collectively as 46 in FIG. 6) that is connected to the woven fabric of the rear panel 14*b*, 16*b* of the respective leg 14, 16, for example, by stitching. As shown in FIG. 7, the inner front pocket layer 40 and outer front pocket layer 42 are joined together, for example, by stitching, to define the interior space ("pouch") of the pocket. As an alternative to joining the inner and outer front pocket layers 40, 42 together, they layers can comprise a single piece of fabric folded over on itself.

Referring back to FIG. 6, each of the front pockets 19 can include an overlayer 48 joined to the outer front pocket layer 40, for example, by stitching, bonding, ultrasonic welding, or other technique known in the art. The overlayer 48 can be formed of a woven fabric to provide added structure to the inner pocket layer 40. According to embodiments, the overlayer 48 can remain at a distance from the top edge 44 and side edge 46 of the inner front pocket layer 40, as shown, for example, in order to maintain flexibility between the front panel 14*a*, 16*a* and rear panel 14*b*, 16*b*, respectively. As shown in FIG. 7, the inner front pocket layer 40 and/or or the outer front pocket layer 42 can overlap a portion of the respective side stretch panel 18, 20.

Figure 3:
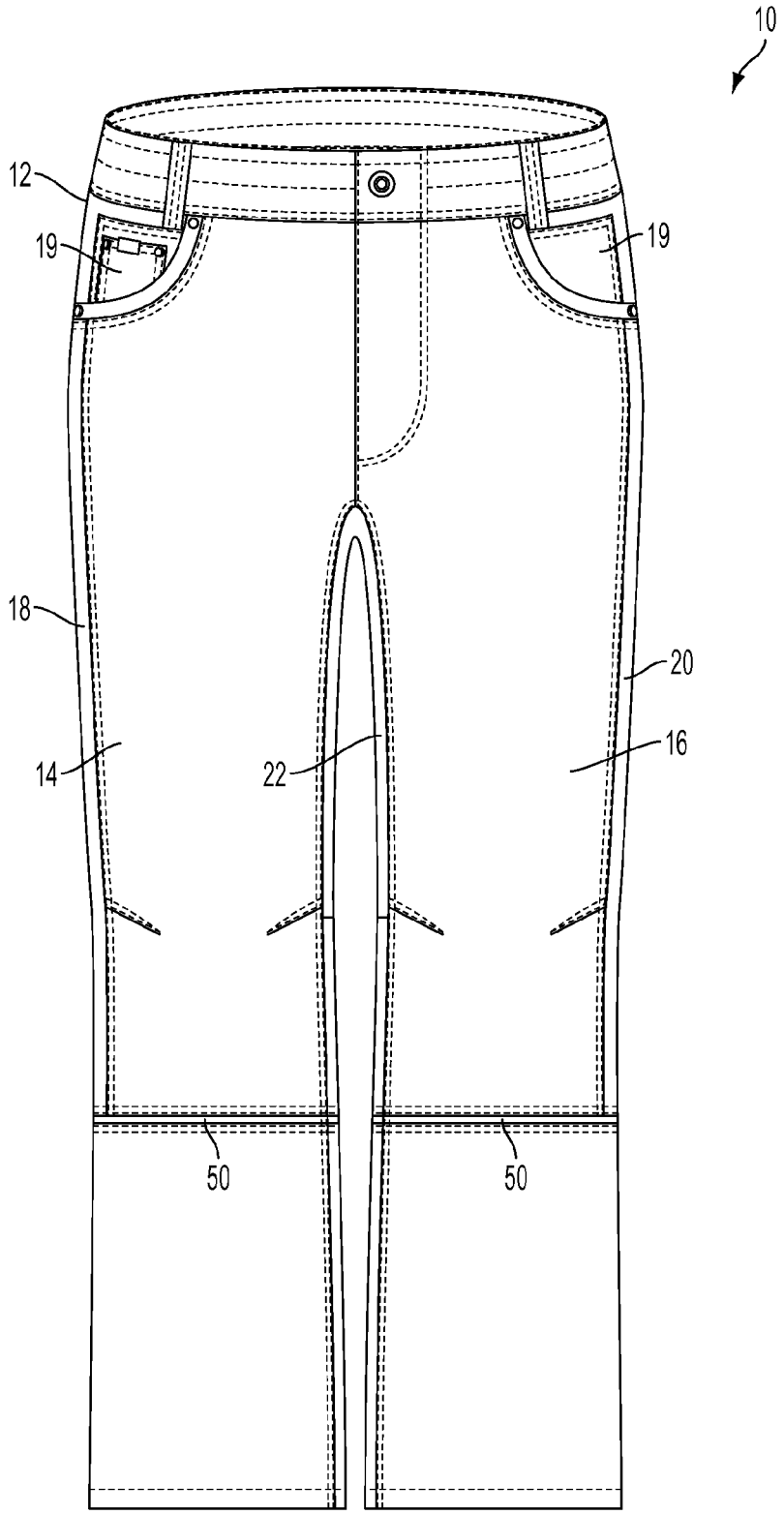
FIG. 3 is a front view of the pants of FIG. 1.

Referring to FIGS. 1, 3, and 7, each of the first and second legs 14, 16 can include a shin stretch panel 50 formed, for example, of a knitted fabric. The shin stretch panel 50 can extend laterally across the respective leg 14, 16, and accordingly, can be bordered on upper and lower edges 50*a*, 50*b* by a woven fabric, for example, that of the front panel 14*a*, 16*a* of the respective leg 14, 16. As a result, the shin stretch panel 50 can divide the woven fabric of the respective front panel 14*a*, 16*a* into upper and lower portions. According to embodiments, the shin stretch panel 50 can also intersect with, and optionally join to, the respective side stretch panel 18, 20. As shown in FIG. 7, the shin stretch panel 50 can comprise a layer of stretch material, such as a knit fabric, joined (e.g., sewn) in between upper and lower woven portions of the respective front panel 14*a*, 16*a*, for example, along upper and lower edges 50*a*, 50*b*, however, other constructions are possible.

Figure 9:
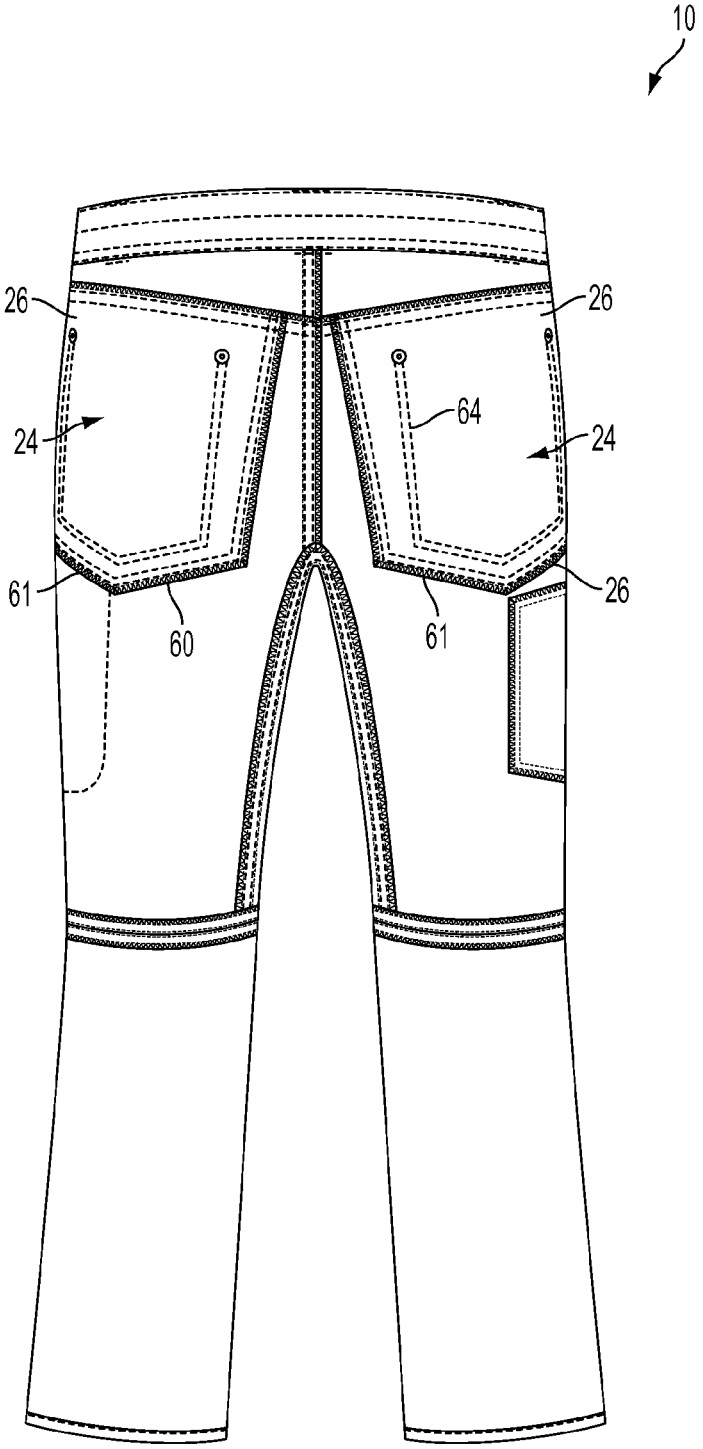
FIG. 9 is a rear view of the pants of FIG. 1, shown inside-out.

Referring to FIGS. 8 and 9, embodiments of the rear pockets 24 are described in more detail. FIG. 8 depicts an enlarged view of one of the rear pockets 24, while FIG. 9 depicts a rear view of the pants 10 shown inside-out. Each of the rear pockets 24 can comprise a rear pocket inner layer 26 in the form of a stretch panel (e.g., a knitted fabric). The rear pocket inner layer 26 can define an outer perimeter 60 that is surrounded on all sides by woven fabric so that the rear pocket inner layer extends past the second outer perimeter on all sides. For example, the outer perimeter 60 of the rear pocket inner layer 26 can be joined over an opening in the pant seat (which can be formed of woven fabric), for example, by stitching 61, bonding, ultrasonic welding, or other techniques known in the art. A rear pocket outer layer 62, for example, formed of woven fabric, can be layered on top of the rear pocket inner layer 26, and can be joined thereto, for example, by stitching 64, bonding, ultrasonic welding, or other techniques known in the art. The rear pocket outer layer 62 can comprise a woven fabric, and in turn, can provide rigidity to the pocket 24 and/or pant seat.

With reference to FIG. 8, the rear pocket outer layer 62 can be bordered on all sides by the woven inner layer 26, thereby defining an "island" in the inner layer 62. This construction can provide flexibility between the outer layer 26 and the pant seat, improving fit and mobility, however, other embodiments are also possible.

Figure 10:
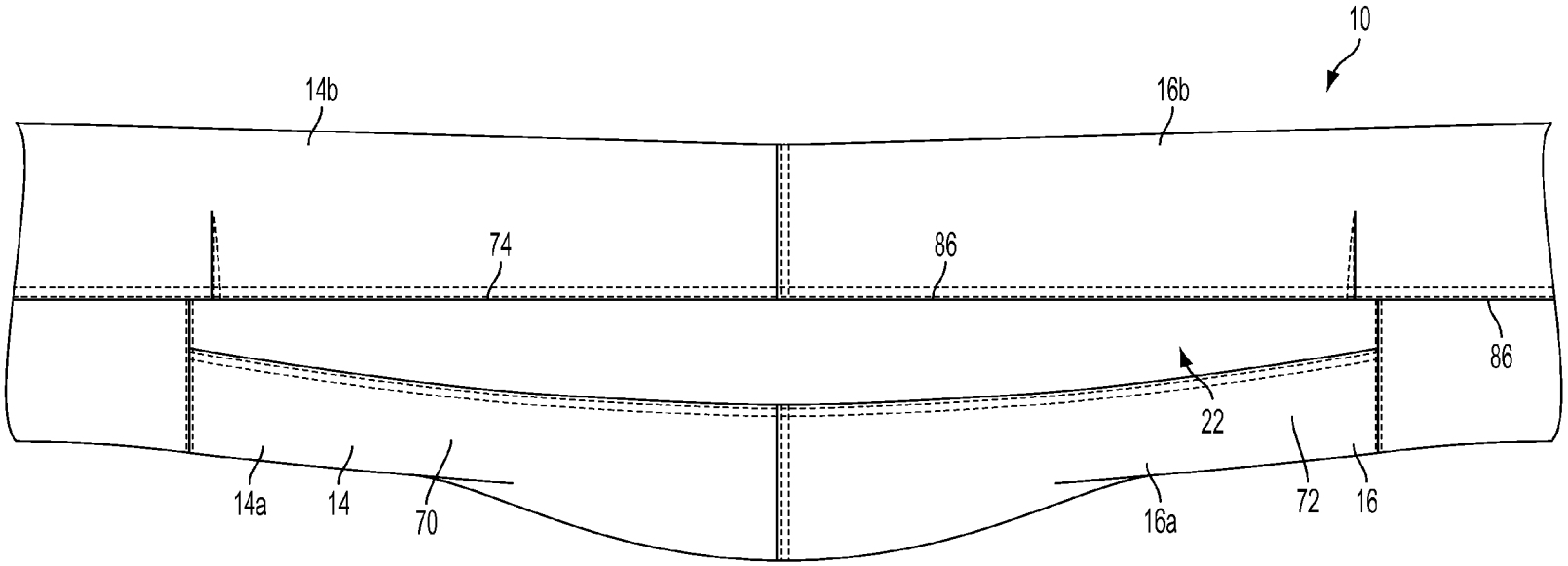
FIG. 10 is a view of a crotch region of the pants of FIG. 1.

Referring to FIG. 10, the pants can include a crotch gusset 22 in the form of a stretch panel. The crotch gusset 22 can extend, generally, from an in inner thigh portion 70 of the first leg 14 to an inner thigh portion 72 of the second leg 16, thereby covering the crotch region. The crotch gusset 22 can be formed of a panel of knit fabric bordered by woven material. For example, the crotch gusset 22 can be sewn between the front and rear panels 14*a*, 14*b* of the first leg 14, and also between the front and rear panels 16*a*, 16*b* of the second leg 16, however, other configurations are possible. The crotch gusset 22 can be joined to the surrounding fabric using stitching 74, bonding, ultrasonic welding, or other techniques known in the art.

According to embodiments, the side stretch panels 18, 20 running along the length of the legs 14, 16, the stretch panels 26 in the rear pockets 24, and the stretch crotch gusset 22 can work in unison to provide a pant that has a woven exoskeleton for durability and structure, while the stretch panels provide comfort, fit, and maneuverability.

Figure 2:
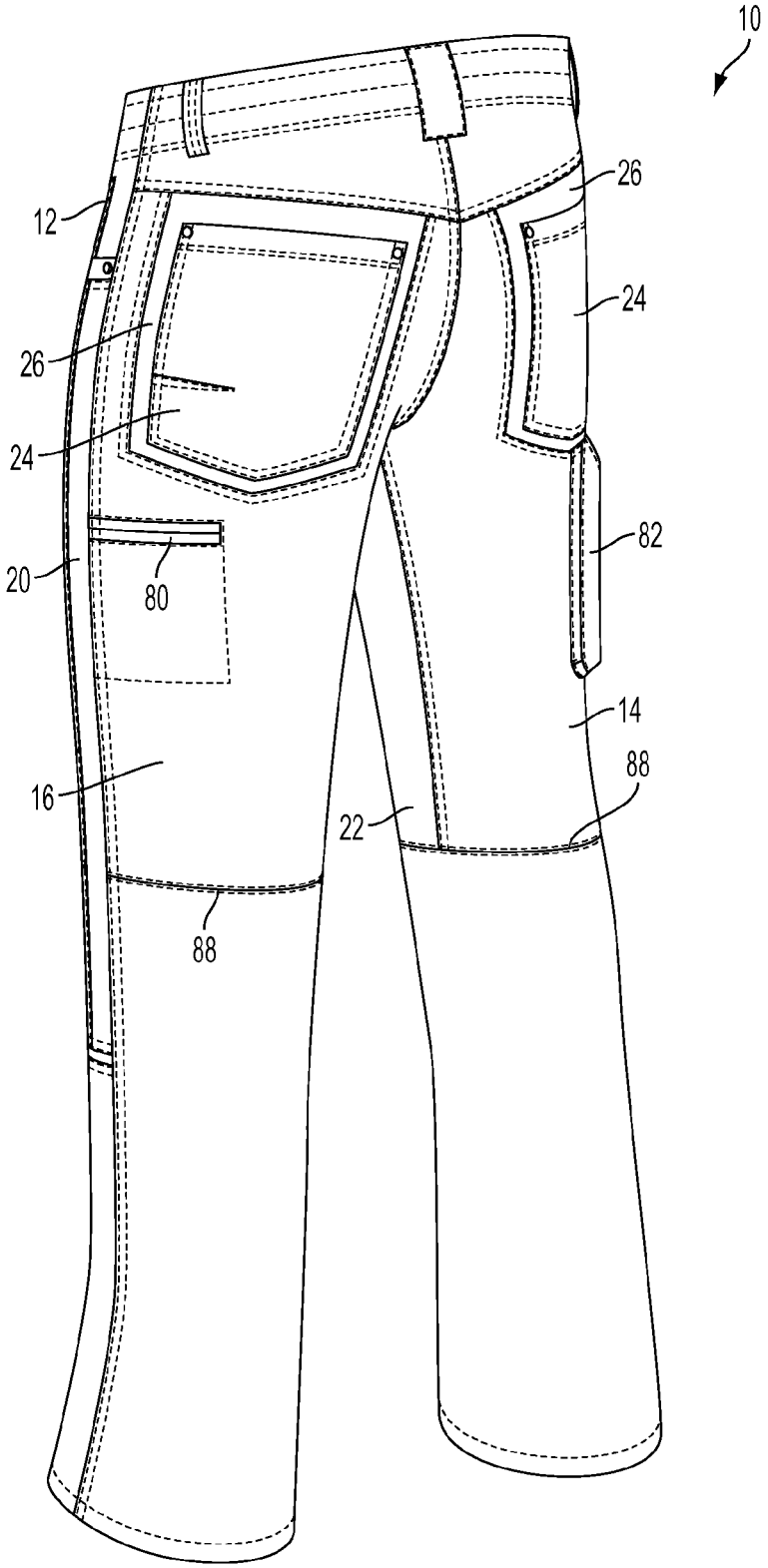
FIG. 2 is a rear-left perspective view of the pants of FIG. 1.
Figure 4:
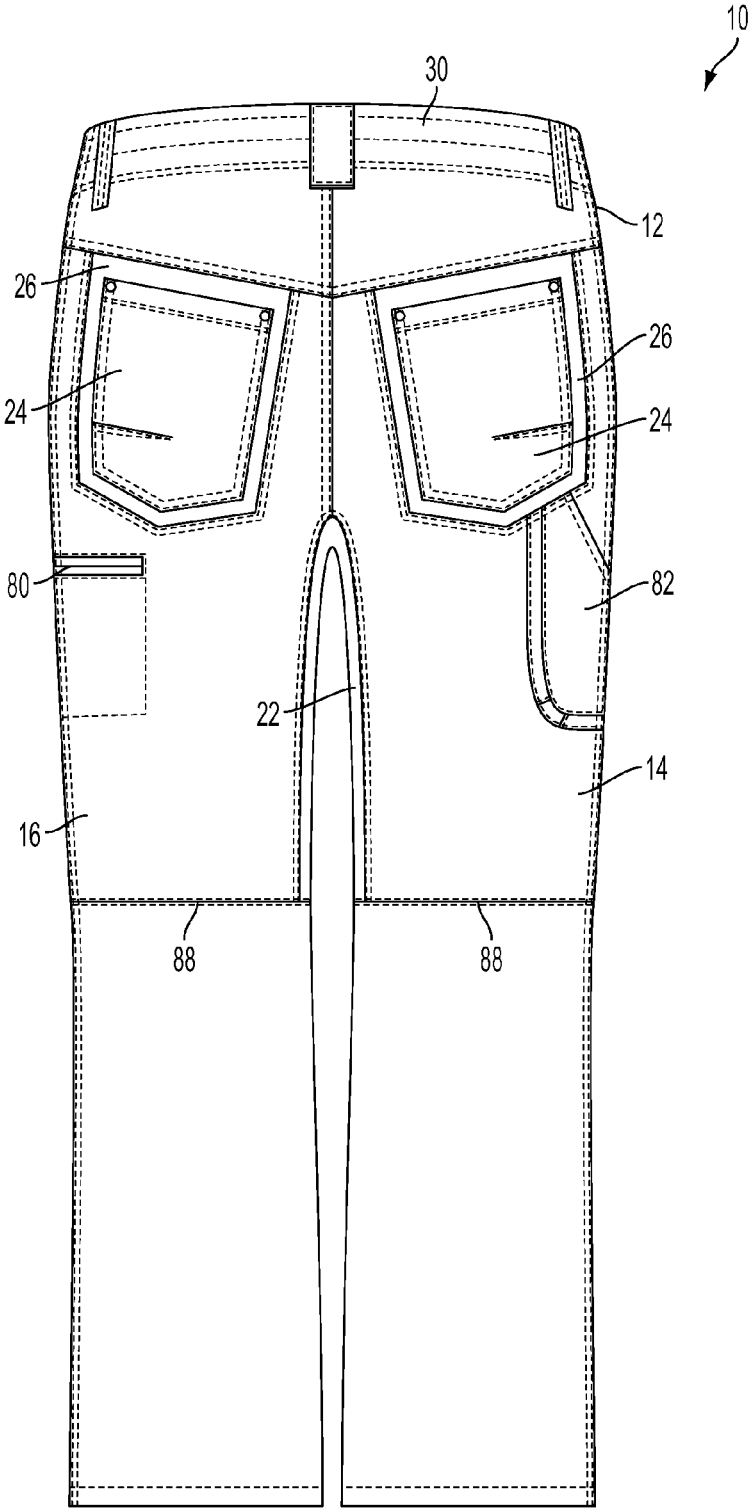
FIG. 4 is a rear view of the pants of FIG. 1.

Referring back to FIGS. 1 and 2, embodiments of pants 10 can include additional features, such as a cell phone pocket 80, and a three-dimensional side pocket 82. As shown in FIG. 1 and discussed previously, according to embodiments, the front panels 14*a*, 16*a* can each be divided into upper and lower portions divided by the shin stretch panels 50. Still referring to FIG. 1, the lower portion of the front panels 14*a*, 16*a* can be joined to the respective rear panels 14*b*, 16*b* by a seam (e.g., a row of stitching) that is substantially continuous with the connection between the side stretch panel 18, 20 and the respective rear panel 14*b*, 16*b*, however, other configurations are possible. As also shown in FIG. 1, the respective front panels 14*a*, 16*a* and rear panels 14*b*, 16*b* can be joined by a seam 86 (e.g., a row of stitching) extending along the inner leg and thigh region of the legs 14, 16. According to embodiments, the seam 86 can extend continuously from the first leg 14 to the second leg 16, across the crotch region, and can border a portion of the crotch gusset 22 (see FIG. 10), however, other embodiments are possible. As shown in FIGS. 2 and 4, a horizontal seam 88 (e.g., a row of stitching) can bisect the rear panels 14*b*, 16*b* of the first and second legs 14, 16.

According to embodiments, all or parts of pants 10 can be constructed from man-made and/or natural fiber fabrics, such as cotton, cotton/nylon blends, cotton/spandex blends, nylon/spandex blends, polyester, and polyester blends. According to embodiments, the "knitted" stretch panels can be constructed from an 87% nylon/13% spandex blend, however, polyester/spandex, or cotton/spandex blends, and other fabrics known in the art, can alternatively be used. According to embodiments, the "woven" fabric can comprise a 60% cotton, 29 percentile on 3% spandex blend. However, according to embodiments, a polyester/spandex blend, a cotton/spandex blend, or polyester, or nylon, or other fabrics known in the art, can be used.

In the foregoing description, reference is made to "stitching" various parts of pants 10 together. However, one of ordinary skill in the art will understand, based on this disclosure, that other construction techniques can alternatively be used, for example, without limitation, bonding, ultrasonic welding, or other technique known in the art.

While various embodiments of the present invention have been described above, it should be understood that they have been presented by way of example only, and not limitation. Thus, the breadth and scope of the present invention should not be limited by any of the above-described embodiments, but should instead be defined only in accordance with the following claims and their equivalents.

What is claimed:

1. Pants, comprising: a waist portion including a waist band; first and second legs extending from the waist portion, each of the first and second legs including a front panel and a rear panel formed at least partially of a woven fabric, and a side stretch panel extending lengthwise along at least a portion of the respective first or second leg of the pants between the front panel and the rear panel and configured to extend along a wearer's outer thigh, the side stretch panel comprising a knitted fabric having fore and aft side edges joined to the front panel and rear panel, respectively; and first and second front pockets located below the waist band, each of the first and second front pockets having a pocket welt formed of a woven fabric, the pocket welt extending from the woven fabric of the front panel at the waist band to the woven fabric of the rear panel of the respective first or second leg of the pants and extending across the fore side edge to the aft side edge of the respective side stretch panel, wherein the waist band extends above the respective first or second front pocket from the woven fabric of the front panel to the woven fabric of the rear panel of the respective first or second leg of the pants.

2. The pants of claim 1, wherein the waist band is formed of a woven fabric, and each pocket welt extends from the waist band to the woven fabric of the rear panel of the respective first or second leg of the pants.

3. The pants of claim 1, wherein each pocket welt comprises two or more overlapping layers of the woven fabric.

4. The pants of claim 1, wherein each of the first and second front pockets further comprises:

an inner front pocket layer formed of knitted fabric and including a top edge that is connected to the waist band, and a side edge that is connected to the woven fabric of the rear panel of the respective first or second leg of the pants; and an outer front pocket layer formed of knitted fabric and including a top edge that is connected to the pocket welt, and a side edge that is connected to the woven fabric of the rear panel of the respective first or second leg of the pants;

wherein the inner front pocket layer and outer front pocket layer are joined together to define an interior pocket space.

5. The pants of claim 4, wherein each of the first and second pockets further comprises an overlayer of woven fabric located on the inner front pocket layer, wherein the overlayer is spaced apart from the waist band and from the rear panel of the respective first or second leg of the pants.

6. The pants of claim 4, wherein at least one of the inner front pocket layer and the outer front pocket layer overlaps a portion of the side stretch panel in the corresponding first or second leg of the pants.

7. The pants of claim 1, wherein each of the first and second legs further comprises a shin stretch panel formed of a knitted fabric, the shin stretch panel extending laterally across the front panel of the respective first or second leg of the pants and intersecting with the respective side stretch panel.

8. Pants, comprising: a waist portion including a waist band; first and second legs extending from the waist portion, each of the first and second legs including a front panel and a rear panel formed at least partially of a woven fabric, and a side stretch panel extending lengthwise along at least a portion of the respective first or second leg of the pants between the front panel and the rear panel and configured to extend along a wearer's outer thigh, the side stretch panel comprising a knitted fabric having fore and aft side edges joined to the front panel and rear panel, respectively; first and second front pockets located below the waist band, each of the first and second front pockets having a pocket welt formed of a woven fabric, the pocket welt extending from the woven fabric of the front panel to the woven fabric of the rear panel of the respective first or second leg of the pants, wherein the waist band extends above the respective first or second front pocket from the woven fabric of the front panel to the woven fabric of the rear panel of the respective first or second leg of the pants; and first and second rear pockets, wherein each of the first and second rear pockets comprises: a rear pocket inner layer of knitted fabric, the rear pocket inner layer defining a first outer perimeter surrounded by woven fabric, wherein the entire first outer perimeter is joined to the surrounding woven fabric; and a rear pocket outer layer of woven fabric joined to and overlaying the rear pocket inner layer, the rear pocket outer layer defining a second outer perimeter, wherein the rear pocket inner layer extends past the second outer perimeter on all sides.

9. The pants of claim 1, further comprising a crotch gusset extending from an inner thigh side of the first leg to an inner thigh side of the second leg, wherein the crotch gusset comprises a knit fabric located between the front and rear panels of both the first and second legs.

10. The pants of claim 1, wherein the side stretch panel extends at least partially along a portion of the respective first or second leg of the pants that covers the wearer's outer thigh.

11. The pants of claim 1, further comprising at least one additional pocket selected from the group consisting of a side pocket, a cell-phone pocket, or a wallet pocket.

12. The pants of claim 1, wherein the woven fabric comprises a nylon/spandex blend, a polyester/spandex blend, or a cotton/spandex blend.

13. The pants of claim 1, wherein the knit fabric comprises a polyester/spandex blend, a cotton/spandex blend, polyester, or nylon.

14. Pants, comprising; a waist portion including a waist band; first and second legs extending from the waist portion, each of the first and second legs including a front panel and a rear panel formed at least partially of a first fabric, and a side stretch panel extending lengthwise along at least a portion of the respective first or second leg of the pants between the front panel and the rear panel and configured to extend along a wearer's outer thigh, the side stretch panel comprising a second fabric having fore and aft side edges joined to the front panel and rear panel, respectively; and first and second front pockets located below the waist band, each of the first and second front pockets having a pocket welt formed of the first fabric, the pocket welt extending from the first fabric of the front panel at the waist band to the first fabric of the rear panel of the respective first or second leg of the pants and extending across the fore side edge to the aft side edge of the respective side stretch panel, wherein the waist band extends above the respective first or second front pocket from the first fabric of the front panel to the first fabric of the rear panel of the respective first or second leg of the pants; wherein the second fabric has a higher degree of stretch than the first fabric.

15. The pants of claim 14, wherein each of the first and second front pockets further comprises: an inner front pocket layer formed of the second fabric and including a top edge that is connected to the waist band, and a side edge that is connected to the first fabric of the rear panel of the respective first or second leg of the pants; and an outer front pocket layer formed of the second fabric and including a top edge that is connected to the pocket welt, and a side edge that is connected to the first fabric of the rear panel of the respective first or second leg of the pants; wherein the inner front pocket layer and outer front pocket layer are joined together to define an interior pocket space.

16. The pants of claim 14, wherein each of the first and second legs further comprises a shin stretch panel formed of the second fabric, the shin stretch panel extending laterally across the front panel of the respective first or second leg of the pants and intersecting with the respective side stretch panel.

17. Pants, comprising: a waist portion including a waist band; first and second legs extending from the waist portion, each of the first and second legs including a front panel and a rear panel formed at least partially of a first fabric, and a side stretch panel extending lengthwise along at least a portion of the respective first or second leg of the pants between the front panel and the rear panel and configured to extend along a wearer's outer thigh, the side stretch panel comprising a second fabric having fore and aft side edges joined to the front panel and rear panel, respectively; first and second front pockets located below the waist band, each of the first and second front pockets having a pocket welt formed of the first fabric, the pocket welt extending from the first fabric of the front panel to the first fabric of the rear panel of the respective first or second leg of the pants, wherein the waist band extends above the respective first or second front pocket from the first fabric of the front panel to the first fabric of the rear panel of the respective first or second leg of the pants, wherein the second fabric has a higher degree of stretch than the first fabric; and first and second rear pockets, wherein each of the first and second rear pockets comprises: a rear pocket inner layer of the second fabric, the rear pocket inner layer defining a first outer perimeter surrounded by the first fabric, wherein the entire first outer perimeter is joined to the surrounding first fabric; and a rear pocket outer layer of the first fabric joined to and overlaying the rear pocket inner layer, the rear pocket outer layer defining a second outer perimeter, the rear pocket inner layer extends past the second outer perimeter on all sides.

18. The pants of claim 14, further comprising a crotch gusset extending from an inner thigh side of the first leg to an inner thigh side of the second leg, wherein the crotch gusset comprises the second fabric and is located between the front and rear panels of both the first and second legs.

19. The pants of claim 14, wherein the first fabric comprises a woven, and the second fabric comprises a knit.

* * * * *